US007866049B2

(12) United States Patent
Brawner

(10) Patent No.: US 7,866,049 B2
(45) Date of Patent: Jan. 11, 2011

(54) UNIVERSAL BLISTER PACK OPENER

(76) Inventor: William Matthews Brawner, 15712 Wickershire Ct., Raleigh, NC (US) 27614

( * ) Notice: Subject to any disclaimer, the term of this patent is extended or adjusted under 35 U.S.C. 154(b) by 435 days.

(21) Appl. No.: 12/069,620

(22) Filed: Feb. 12, 2008

(65) Prior Publication Data

US 2009/0199346 A1 Aug. 13, 2009

(51) Int. Cl.
*B26B 3/00* (2006.01)

(52) U.S. Cl. ..... 30/294; 30/280; 30/317

(58) Field of Classification Search ..... 30/278, 30/279.2, 280, 294, 353, 355, 279.6, 314, 30/317; D8/98; 7/156
See application file for complete search history.

(56) References Cited

U.S. PATENT DOCUMENTS

| | | | | | |
|---|---|---|---|---|---|
| 645,447 | A | * | 3/1900 | Allen | 30/279.6 |
| 1,095,617 | A | * | 5/1914 | Armitage | 30/339 |
| 1,638,807 | A | * | 8/1927 | Hopwood | 30/318 |
| 1,757,073 | A | * | 5/1930 | Boyle | 30/286 |
| 2,049,898 | A | * | 8/1936 | Driest | 279/43 |
| 2,807,877 | A | * | 10/1957 | Fryer et al. | 30/280 |
| 2,832,134 | A | * | 4/1958 | Lukan | 30/443 |
| 2,873,809 | A | * | 2/1959 | Loomis | 172/376 |
| 2,881,520 | A | * | 4/1959 | Mito | 30/280 |
| 3,001,284 | A | | 9/1961 | Merotz | |
| 3,328,877 | A | * | 7/1967 | Brown | 30/142 |
| 3,915,393 | A | | 10/1975 | Elkins | |
| 4,021,912 | A | * | 5/1977 | Stanfield | 30/280 |
| 4,221,222 | A | * | 9/1980 | Detsch | 606/132 |
| 4,384,649 | A | | 5/1983 | Brodsky | |
| 4,569,130 | A | * | 2/1986 | Koller et al. | 30/128 |
| 4,761,855 | A | * | 8/1988 | Peters | 452/161 |
| 4,877,609 | A | * | 10/1989 | Beck et al. | 426/87 |
| 4,909,414 | A | | 3/1990 | Heath | |
| 4,975,015 | A | | 12/1990 | Harding | |
| 5,019,125 | A | | 5/1991 | Rebne et al. | |
| 5,109,984 | A | | 5/1992 | Romick | |
| 5,127,162 | A | * | 7/1992 | Mansfield | 30/294 |
| 5,217,477 | A | * | 6/1993 | Lager | 606/167 |
| 5,237,899 | A | * | 8/1993 | Schartinger | 83/454 |
| 5,348,158 | A | | 9/1994 | Honan et al. | |
| 5,368,187 | A | | 11/1994 | Poncetta et al. | |
| 5,431,283 | A | | 7/1995 | Weinstein et al. | |
| 5,472,115 | A | | 12/1995 | Whiton | |
| 5,524,348 | A | | 6/1996 | Tipp | |
| 5,722,563 | A | | 3/1998 | Hunts | |
| 5,791,513 | A | | 8/1998 | Intini | |
| 5,853,101 | A | | 12/1998 | Weinstein | |
| 5,896,667 | A | | 4/1999 | Hawkins | |

(Continued)

*Primary Examiner*—Hwei-Siu C Payer
(74) *Attorney, Agent, or Firm*—MacCord Mason PLLC

(57) ABSTRACT

A hand tool for removing individual items contained in a blister package having an upper surface with raised protrusions with a given individual width containing each item and a lower sheet that holds the items within the protrusions. The hand tool includes a cutting blade having a piercing tip and slicing arms that extend outwardly from opposite sides of the piercing tip. Also included is a handle that is usable for urging the piercing tip through a protrusion and beneath a product item such that the blade will slice into the protrusion between the item and the package lower sheet. The configuration of the blade's piercing tip and slicing arms generate tactile force feedback to the user. The tactile force feedback guides the user to apply appropriate force to open the raised protrusion enough to empty its contents without damaging or losing the contents.

17 Claims, 6 Drawing Sheets

U.S. PATENT DOCUMENTS

| | | | | |
|---|---|---|---|---|
| 6,098,835 | A | 8/2000 | DeJonge | |
| D439,127 | S * | 3/2001 | Loudon | D8/98 |
| 6,206,233 | B1 | 3/2001 | Schulze | |
| 6,460,693 | B1 | 10/2002 | Harrold | |
| 6,487,776 | B2 | 12/2002 | Chang | |
| 6,557,740 | B1 | 5/2003 | Dent | |
| 6,901,663 | B2 | 6/2005 | Grieve | |
| D517,884 | S | 3/2006 | Ellingwood | |
| 7,059,054 | B2 | 6/2006 | Pilchowski | |
| D533,661 | S | 12/2006 | Yip | |
| 7,264,137 | B2 | 9/2007 | Drought et al. | |
| 7,284,661 | B1 | 10/2007 | Evans et al. | |
| 2004/0111803 | A1 | 6/2004 | Mazur | |
| 2005/0139605 | A1 | 6/2005 | Benktzon et al. | |
| 2005/0210682 | A1 | 9/2005 | Bartholin | |

* cited by examiner

UNIVERSAL BLISTER PACK OPENER

BACKGROUND OF THE INVENTION (1) Field of the Invention

The present invention generally relates to blister pack openers and in particular to an improved universal blister pack opener.

(2) Description of the Prior Art

The use of blister packaging to contain products is widely practiced by a variety of companies. These packages are used to contain products from batteries to medicament. People frequently have difficulty opening these blister packs due to enhanced pack construction. These people prefer to open the blister packs quickly, and with a minimum of difficulty.

Most often blister packs are opened by a person using their fingers to apply force to the blister protrusion on top of the blister pack and forcing the product through the lidding material on the bottom of the pack. This process takes time to apply the proper force, causes finger strain, and frequently causes the product contained therein to be quickly ejected in an uncontrolled manner when the lidding foil breaks. Alternatively, using sharp implements not intended for opening blister packs creates a safety risk to the user and risks damaging the product. These factors are major deterrents to opening a blister pack. However, not opening the blister pack is not an option since the benefits of the product contained therein cannot be realized without removing it from its packaging. These problems exist in private and professional situations where blister packaging is opened.

The difficulty in accessing a blister pack is a great concern, especially when the product therein, possibly medicament, must be used as quickly as possible. U.S. Pat No. 5,431,283 to Weinstein et al. (1995) shows a device that applies pressure to the blister protrusion forcing the product to be ejected through the lidding material. While this device removes the product from the blister pack, a single embodiment cannot accommodate a large variety of blister sizes or blister orientations. Additionally, this design risks breakage of the product by applying force with a device much harder and differently shaped than the human finger for which the pack was designed. Finally, this design fails to work with blister packs containing the popular reinforced multilayer lidding material which requires the initial layer be peeled off before the medicament can be pushed through the frangible second layer.

U.S. Pat No. 5,853,101 to Weinstein (1998) shows a blister opening device containing an orifice in which the blister is held such that a mating protrusion can puncture the lidding material. This device is inferior because it requires a differently shaped orifice for differently sized blisters and thus cannot be used on a variety of blister orientations. It also lacks the ability to access blisters multiple positions deep within a blister card because blisters or rigidity strips close to the hinge point prevent the device from fully closing.

All the devices heretofore known suffer from one or more of the following disadvantages:

a. Does not reduce the force required to open a blister pack.

b. Does not allow use on varying sizes of blisters including round and elongated blisters.

c. Exerts pressure on the medicament contained within the blister that could potentially cause a breakage.

d. Pinching the blister from the top and bottom requires a one piece device to be inconveniently long in order to reach across the many types of card configurations.

e. One piece devices that pinch the blister from the top and bottom of the card do not have clearance to be usable when a second blister exists between the blister to be opened and the hinge. Attempts to use such a device can inadvertently open or damage the contents of the secondary blister.

f. Ejects blister contents in an uncontrolled manner.

g. Ejects blister contents underneath the card and out of view.

h. Device is specific to one blister configuration and cannot be used with dissimilar configurations (round and elongated).

i. Cannot open blisters in a wide variety of patterns, including patterns with blisters in close proximity to one another.

j. Does not provide additional resistance to the user prior to completely severing the blister from the blister card.

SUMMARY OF THE INVENTION

The present invention relates to a blister pack dispensing device for removing product from a blister package such as a blister card, and particularly to a hand tool that removes the product items quickly, easily, and reduces degrading influences on the product when dispensed.

Generally, the present invention is a hand tool for removing individual items contained in a blister package having an upper surface with raised protrusions with a given individual width containing each item and a lower sheet (i.e., a lower surface lidding material) that holds the items within the protrusions. In particular, the hand tool of the present invention is made up of a cutting blade having a piercing tip and slicing arms that extend outwardly from opposite sides of the piercing tip, and a handle having proximal and distal ends. The handle is usable for urging the piercing tip through a raised protrusion and beneath a product item such that the blade will slice into the protrusion between the item and the package lower sheet.

In a first embodiment, the hand tool is made up of a flat base that is rounded at one end and includes spaced parallel guide arms that are spaced greater than a given width of a raised protrusion. The guide arms terminate leaving an access opening at the base opposite end. The access opening is of sufficient size to allow the base to be placed over a raised protrusion (i.e., a blister), or slid over a raised protrusion via the opening. When positioned over a raised protrusion, the base contacts the blister package upper surface surrounding the raised protrusion.

Just inside the rounded portion of the base is the cutting blade having a piercing tip and slicing arms that extend outwardly from opposite sides of the piercing tip. This particular blade configuration allows for an additive edge cutting strategy to vary cutting force and provide resistive force feedback to the user. The blade's piercing tip extends in the direction of the hand tool's base open end.

The blade's piercing tip has a forward end and a rear end with the slicing arms to cut the raised protrusion at the initial puncture point using a minimum of force. The present invention's blade configuration reduces the force the user must exert to begin the cut, thus allowing the piercing tip and slicing arms to be used as a saw tooth on hard to cut raised protrusions by pivoting the hand tool from side to side. Increased resistance provides tactile feedback in the form of resistive force just before the raised protrusion is completely severed. The increased resistance is caused by the piercing tip attempting to pierce the back-side of the raised protrusion from the inside. Combined with the slicing arms already cutting, this creates three cutting points that provide increased resistance to the user. Once this resistance is realized, the user can either stop applying force to keep the blister attached to the blister package upper surface, or continue applying force to completely sever the raised protrusion from the blister package upper surface.

This embodiment of the invention also includes a rectangular handle having a bottom surface that is spaced above the base and the blade. Moreover, the distal end of the handle extends in a plane above the blade. The handle includes two handle supports that attach the handle to the base's parallel guide arms. Moreover, the handle supports are tapered away from the rounded end of the base to allow visibility of cutting progress. The handle supports also provide rigidity to the base as well as support the handle at a predetermined distance above the base to allow sufficient room for a severed raised protrusion to pass between the handle's bottom surface and the base. The base's open end allows a raised protrusion longer than the hand tool base to be fed toward the blade.

The hand tool is operated by sliding the hand tool base over the blister package upper surface such that the base's parallel guide arms guide the piercing tip of the blade into a raised protrusion (i.e., blister). The user continues to apply force to urge the blade cutting arms to penetrate the raised protrusion and pass under the product item contained therein.

Should the user not want the raised protrusion to be fully severed from the blister card upper surface, the sliding motion will be stopped once the added resistance of the tip contacting the back of the raised protrusion is realized. Twisting or elevating the hand tool can then raise the base rounded end to encourage the initially severed end of the raised protrusion to rise from the blister package upper surface, allowing easy access to the product item contained therein.

In a second embodiment of the invention, a handle is in physical communication with the base via a handle support. The handle support is attached to the open end of the base on each side and extends away from the base at an incline. The handle support contains an opening for allowing sufficient clearance above the open end of the base to slide the hand tool over a raised protrusion. The handle support opening extends only along a portion of the handle support length to prevent a loss of rigidity. Affixed to the upper portion of the handle support is a handle of conventional design as typically seen on kitchen utensils such as knives and forks.

OBJECTS AND ADVANTAGES

Accordingly, several object and advantages of the present invention are:

a. To provide a new and novel hand tool for safely dispensing product from a blister pack.

b. To provide a new and novel hand tool that improves the accessibility of a product within blister packs. (older individuals and those with disease frequently do not have the dexterity to open the packs.).

c. To provide a new and novel hand tool that enables blister packs to be opened from the top of the blister card in view of the user (as opposed to under the blister card)

d. To provide a new and novel hand tool that enables the dispensing of blister packs without requiring the opener to push the medicament through the pack and causing stress on the users fingers.

e. To provide a new and novel hand tool that enables blister packs to be opened without having to consider, and if present remove, multiple layers of lidding material.

f. To provide a hand tool that enables the user to quickly and easily dispense medicament from a blister pack.

g. To provide a hand tool that dispenses medicament from a blister card without tearing the card into multiple pieces. The conventional method of pushing the medicament through the lidding foil commonly detaches foil from the blister pack.

h. To provide a hand tool that dispenses medicament from a blister card that is not product or blister orientation specific and can be used on a diversity of blister configurations.

i. To provide a hand tool that requires less user force than punching the product through the lidding material of a blister pack.

j. To provide a hand tool with the ability to open blisters of any length.

k. To provide a hand tool that dispenses blisters in close proximity to one another on a blister card.

Further objects and advantages of the present invention will become apparent from a consideration of the drawings and ensuing description.

LIST OF REFERENCE NUMERALS

1. Hand Tool (generally)
2. Blade Support
3. Cutting Blade
4. Piercing Tip
5. Handle support
6. Handle
7. Handle Distal End
8. Access Opening
9. Parallel Guide Arms
10. Slicing Arms
11. Raised Protrusion (i.e., Blister)
12. Product Item
13. Hand Tool (second embodiment)
14. Handle (second embodiment)
15. Blade Support (second embodiment)
16. Handle Support (second embodiment)
17. Guide Rails (second embodiment)
18. Handle Support Opening (second embodiment)
19. Blade (second embodiment)
20. Piercing Tip (second embodiment)
21. Slicing Arms (second embodiment)

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

First Embodiment Description

Figure 1:
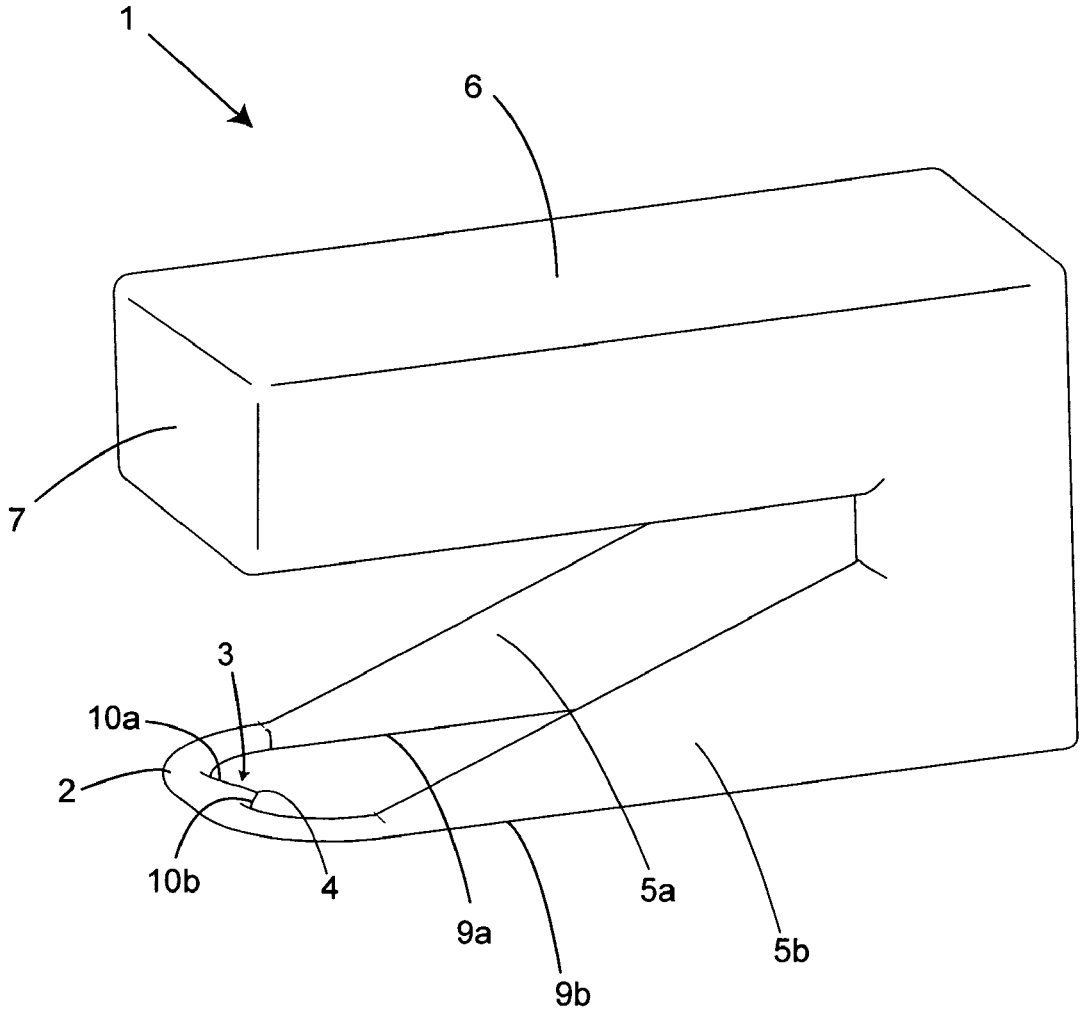
FIG. 1 Blister Pack Opener Composite (Side)
FIG. 2 Blister Pack Opener Composite (Rear)
FIG. 3 Blister Pack Opener Side View
FIG. 4 Blister Pack Opener Bottom view
FIG. 5 Additive Cutting Point Strategy (Step 1)
FIG. 6 Additive Cutting Point Strategy (Step 2)
FIG. 7 Additive Cutting Point Strategy (Step 3)
FIG. 8 Additive Cutting Point Strategy (Step 4)
FIG. 9 Second Embodiment of the Hand Tool (Perspective View)
FIG. 10 Second Embodiment of the Hand Tool (Side View)

FIG. 1 shows a composite side drawing of a hand tool, generally 1 that is an embodiment of the universal blister pack opener of the present invention. A base or blister card contact area, is shown as the lower surface on which hand tool 1 sits.

Figure 2:
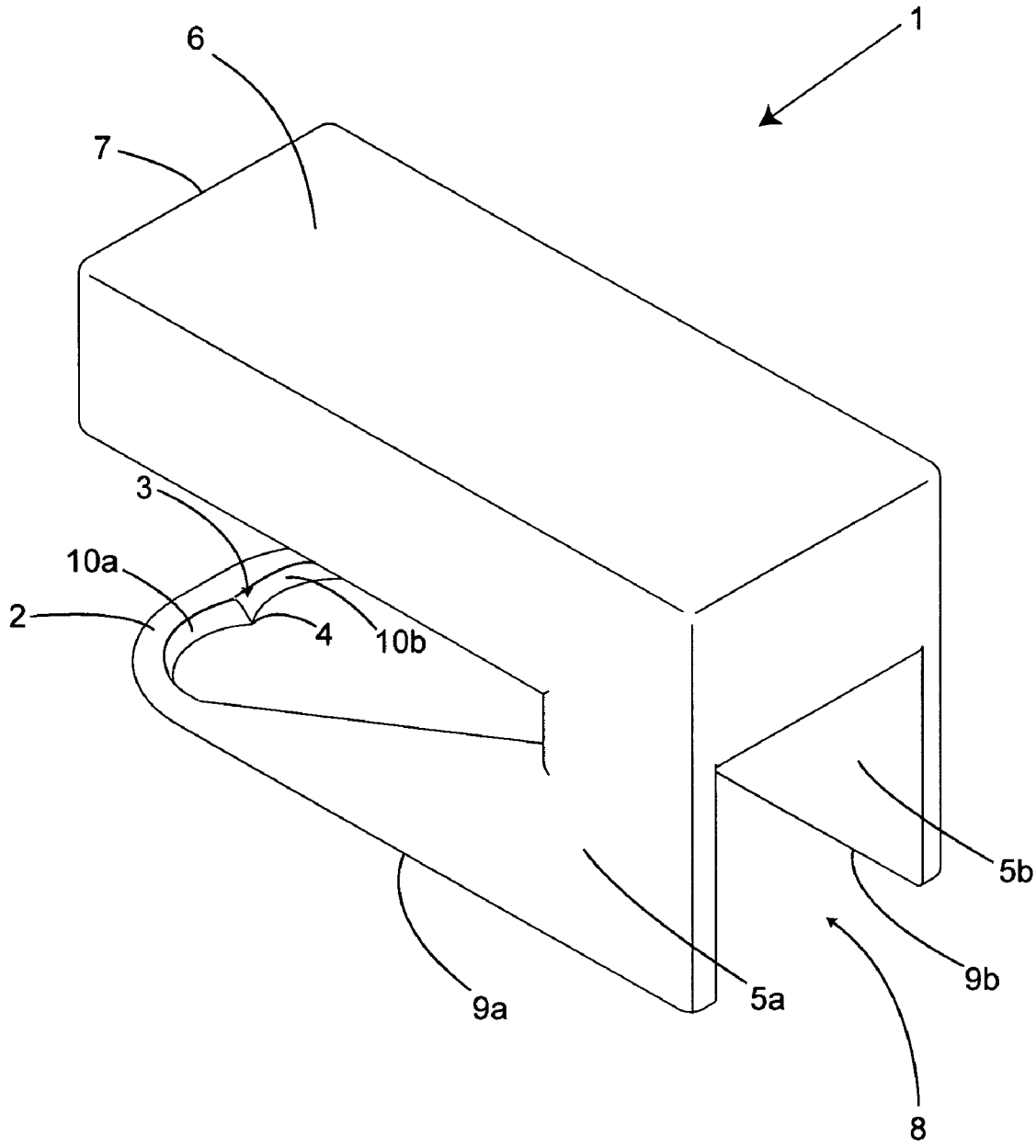

The base is made up of a curved blade support 2, parallel guide arms 9*a* and 9*b*, and an access opening 8, which is best seen in FIG. 2. Attached to the blade support is a cutting blade 3 having slicing arms 10*a*, 10*b* and a piercing tip 4. Extending upwardly from each of parallel guide arms 9*a* and 9*b* are handle supports 5*a*, 5*b*. A handle 6 is attached to handle supports 5*a* and 5*b* on opposite sides of blade support 2.

FIG. 2 shows a composite drawing of hand tool I as viewed from its opposite or proximal end. Access opening 8 is located at the rear of the hand tool for providing an entrance for raised protrusions to be sliced open. A raised protrusion (i.e., blister) will pass through access opening 8 and between parallel guide arms 9 and handle supports 5*a* and 5*b* as it approaches piercing tip 4.

Figure 3:
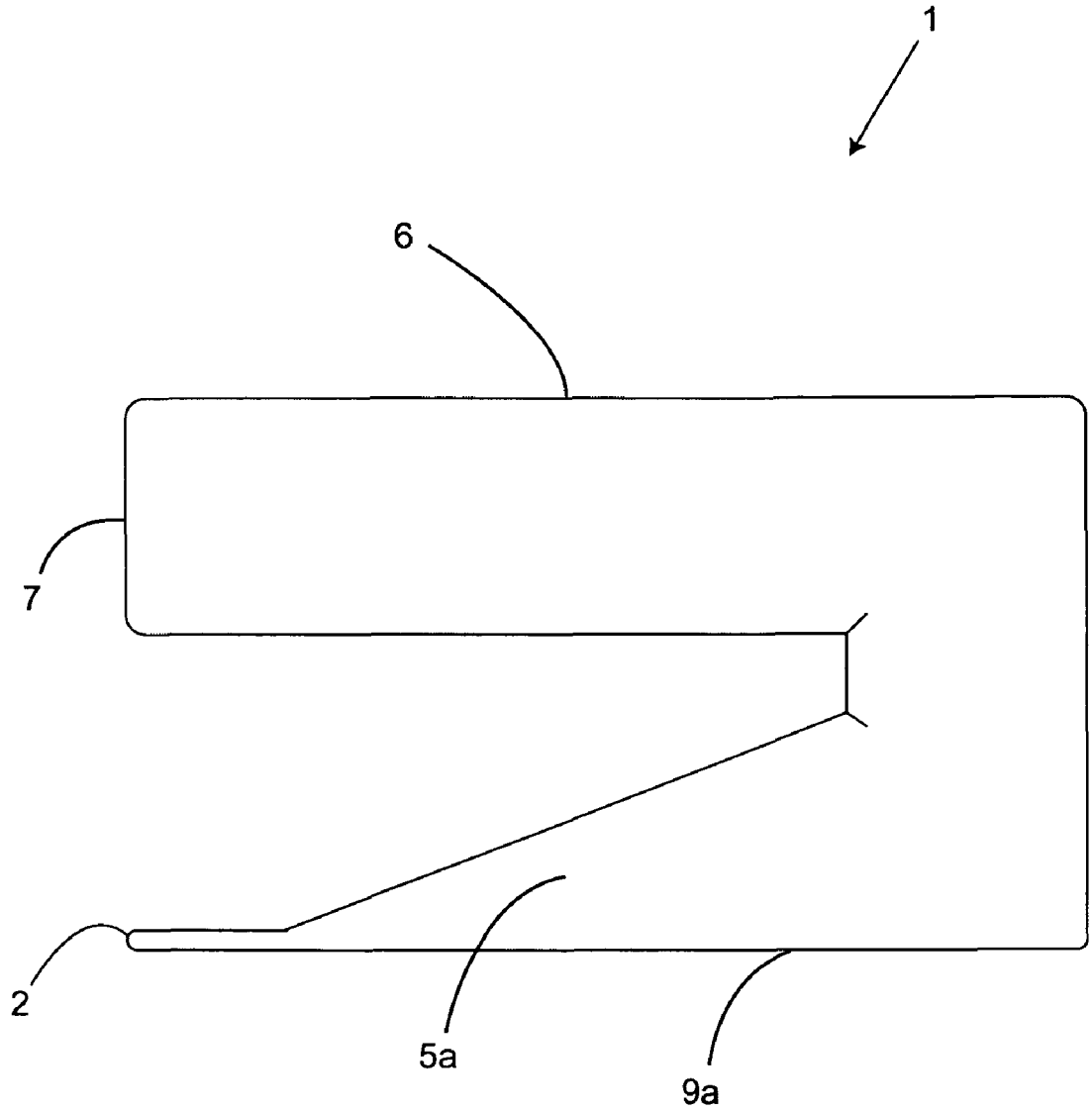

FIG. 3 shows the Blister Pack Opener Side View of hand tool 1. Handle supports 5*a* and 5*b* also connect to parallel guide arms 9*a* and 9*b*.

Figure 4:
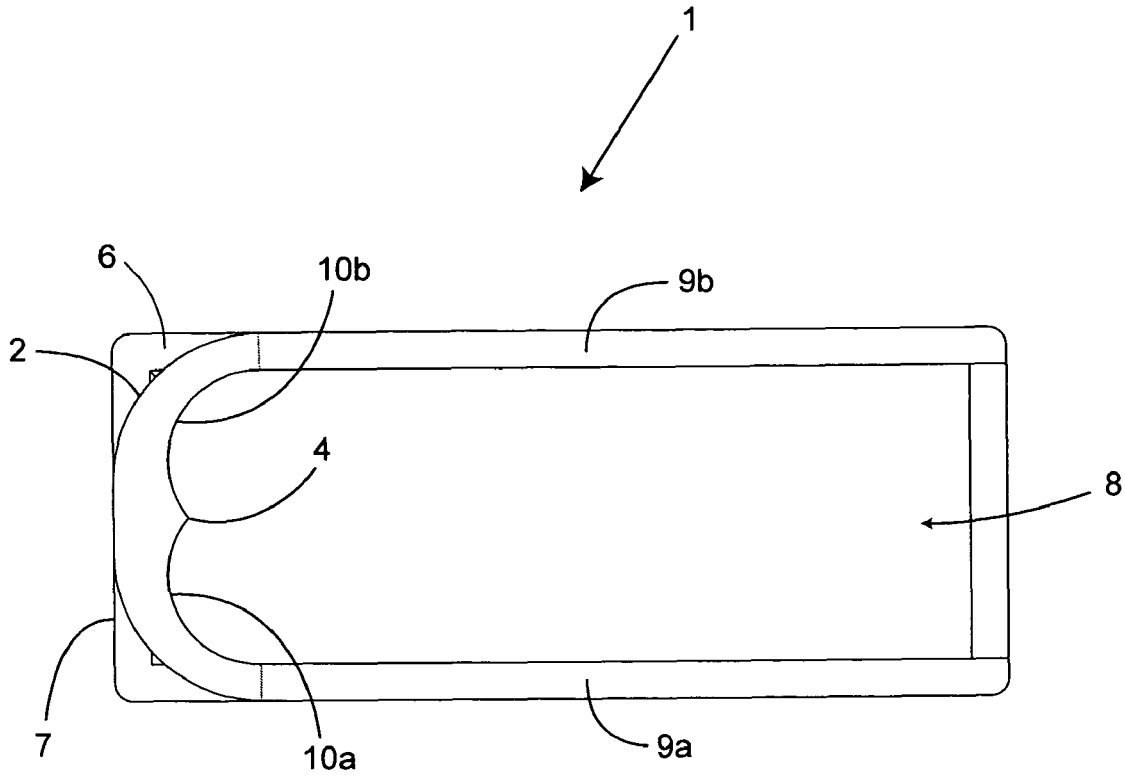

FIG. 4 shows the Blister Pack Bottom View of hand tool 1. The base with curved blade support 2 can be seen in front of the partially visible handle supports 5*a* and 5*b*. The slicing arms 10*a* and 10*b* and piercing tip 4 are on the left side of this view. The lower surface of handle 6 is visible between parallel guide arms 9*a* and 9*b*.

In the following descriptions of the additive cutting strategy, FIGS. 5-8 all show views of hand tool 1 and raised protrusion 11 without showing handle 6. A product item 12 shown in dashed lines is contained within raised protrusion 11. Product item 12 can be but is not limited to medicaments such as pills, tablets and capsules. Starting with FIG. 5, the additive cutting strategy uses an initial cutting point, in which piercing tip 4 punctures a raised protrusion (i.e., blister) that has passed through opening 8 while being guided by parallel guide arms 9*a* and 9*b*.

Figure 6:
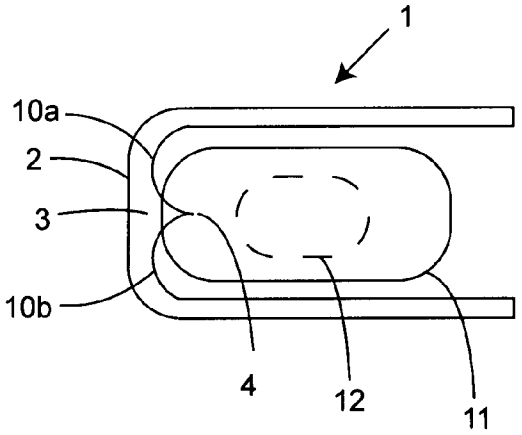

FIG. 6 shows the additive cutting strategy including two additional cutting points as the slicing arms 10*a*, and 10*b* cut into the raised protrusion 11 and slice away from the initial cutting point. Blade 3 made up of slicing arms 10*a* and 10*b* and piercing tip 4 are beveled or directed such that product item 12 passes over blade 3 within the space between the blade and the lower surface of handle 6 (not shown).

Figure 7:
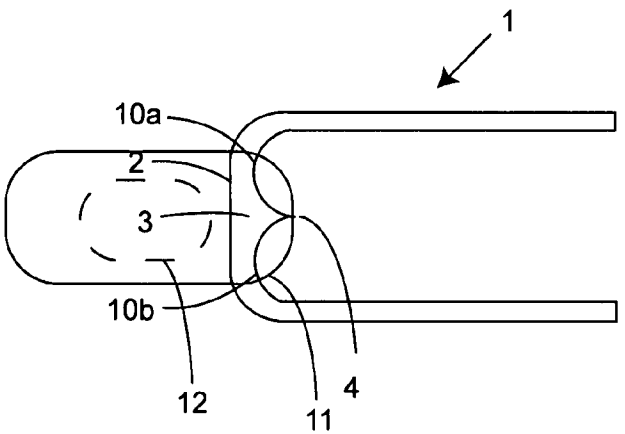

FIG. 7 shows the additive cutting strategy using the slicing arms 10*a*, and 10*b* to continue cutting the raised protrusion 11 as piercing tip 4 makes contact with the inside surface of the back of raised protrusion 11.

Figure 8:
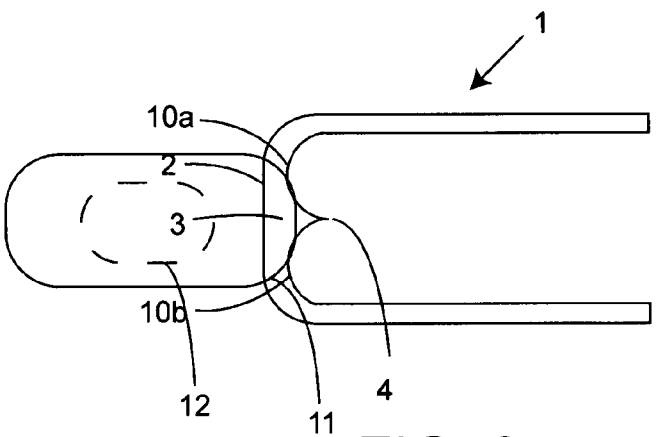
Figure 5:
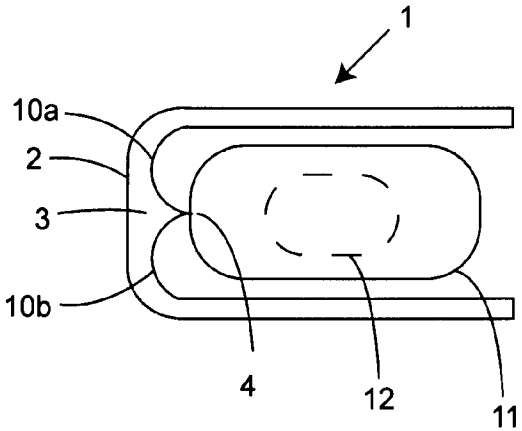

FIG. 8 shows the additive cutting strategy using more cutting points; slicing arms 10*a*, 10*b* cut raised protrusion 11 from its outside to its inside, and also from the puncture point outwardly. As piercing tip 4 makes its way between its position contacting the inside surface of raised protrusion 11 and puncturing raised protrusion 11, the user will feel a resistive feedback. The user may then decide to continue to completely sever the raised protrusion or he may decide to stop and withdraw piercing tip 4 to leave the raised protrusion partially attached to the blister package upper surface.

Operation of the First Embodiment

The user grasps the Universal Blister Pack Opener hand tool by the handle 6 and locates it over raised protrusion 11 containing product item 12. The user maneuvers the base of hand tool 1 onto the blister package upper surface such that parallel guide arms 9*a* and 9*b* are positioned to guide raised protrusion 11 through access opening 8. The additive edge cutting process is initiated by sliding hand tool 1 on the blister package upper surface and in the direction of the raised protrusion 11. At any time during this process, moving hand tool 1 from side to side creates a sawing and slicing effect that assists the movement of the cutting blade 3 through raised protrusion 11. An initial cutting point occurs when piercing tip 4 makes contact with the outside surface of raised protrusion. Slicing arms 10*a* and 10*b* on opposite sides of piercing tip 4 cut outwardly from the cutting point as piercing tip 4 penetrates the raised protrusion. After passing beneath product item 12, piercing tip 4 will pierce the inside of the back of the raised protrusion. The added resistance of the piercing point contact is detectable by the user who can choose to stop the sliding motion if the raised protrusion is not to be completely severed from the blister package upper surface. Raising the rounded end of hand tool 1 by twisting or elevating hand tool 1 encourages the initially severed end of the raised protrusion to rise from the blister package upper surface, allowing easy access to the product contained therein.

If the raised protrusion is to be completely severed from the blister package upper surface, the user continues to slide the hand tool along its original path. This causes piercing tip 4 to puncture the back of the raised protrusion from the inside, and allows the slicing arms 10*a* and 10*b* to cut away from the puncture point, creating more cutting points. Continuing to slide the hand tool completely severs the raised protrusion from the blister package upper surface. The user can then remove the product from the package lower surface.

Second Embodiment Description and Operation

Figure 9:
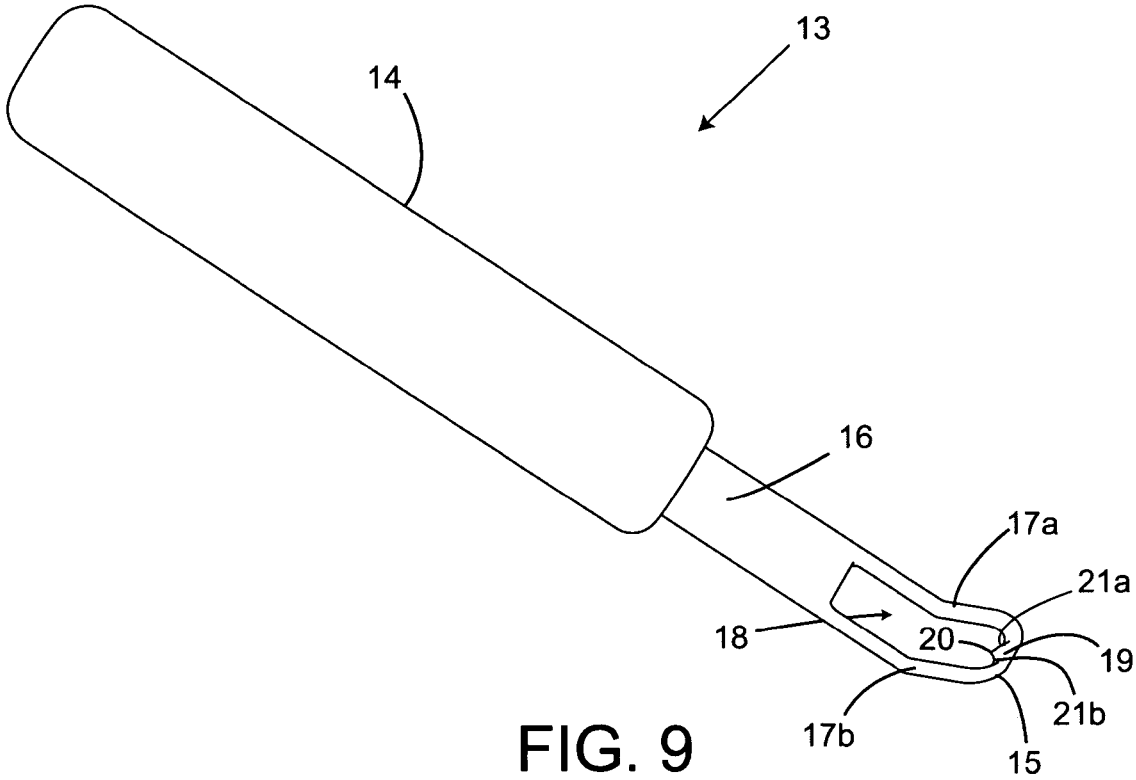
Figure 10:
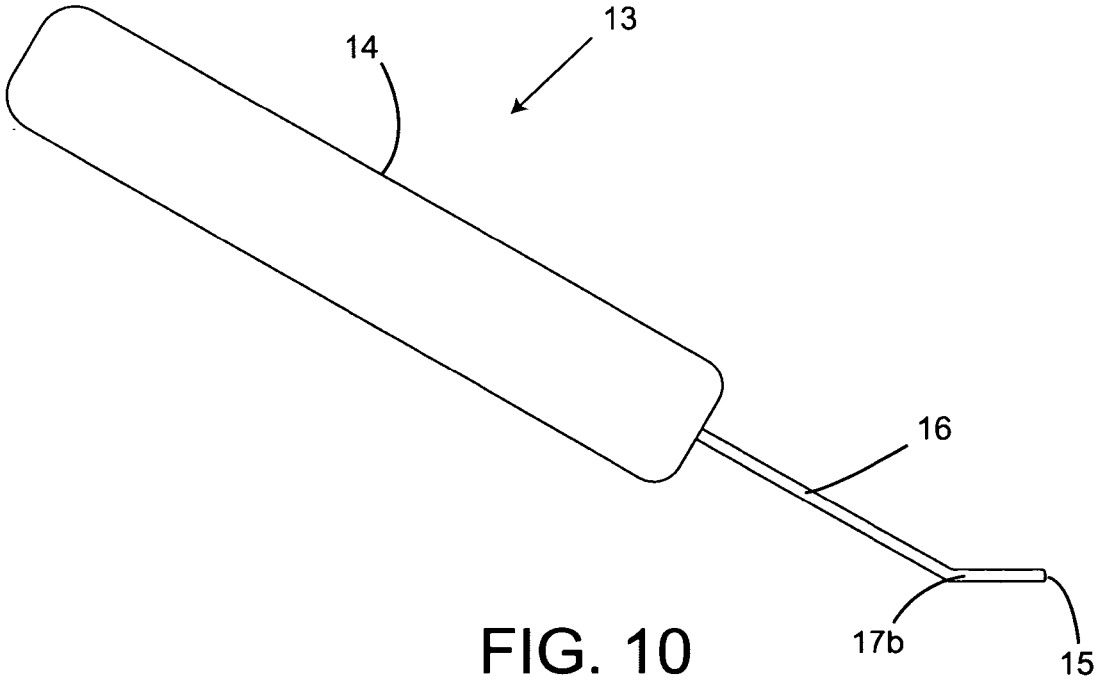

FIGS. 9 and 10 show a second embodiment of the hand tool, generally 13. In this embodiment, a handle 14 is in physical communication with the blade support 15 via a handle support 16. Handle support 16 is attached to the open end of blade support 15 on each side of guide rails 17*a* and 17*b*. Handle support 16 extends away from blade support 15 at an incline. Handle support 16 includes an opening 18 for allowing sufficient clearance above the open end of blade support 15 to slide the hand tool over a raised protrusion. Handle support opening 18 extends only along a portion of the handle support length to prevent a loss of rigidity. Handle 14 is of conventional design as typically seen on kitchen utensils such as knives and forks.

Importantly, this second embodiment includes a blade 19 having a piercing tip 20 and slicing arms 21*a* and 21*b*. In particular, blade 19 uses the same configuration as blade 3 of the first embodiment. In operation, hand tool 13 is pulled by handle 14 such that a raised protrusion passes through handle support opening 16 and comes in contact with piercing tip 20. Moving hand tool 13 from side to side creates a sawing and slicing effect that assists the movement of the cutting blade 19 through a raised protrusion. As in the operation of the first embodiment, the user will receive tactile force feedback that will help him determine the amount of force needed to open or completely sever a raised protrusion from a blister package upper surface.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A hand tool for removing individual items contained in a blister package having an upper surface with raised protrusions having a given width containing said items and a lower sheet holding said items within said protrusions, said tool comprising:

a) a base having a first end, a base open end opposite said first end, and parallel guide arms spaced at a distance to define a protrusion receiving space between said arms, said arms having distal and proximal ends;

b) a cutting blade on the inside of said first end toward said protrusion receiving space and said base open end, said blade consisting essentially of a piercing tip and slicing arms, said piercing tip extending toward said open end and said slicing arms extending outwardly from opposite sides of said tip, said slicing arms having distal ends integral with the distal ends of said guide arms; and c) a handle attached to the proximal ends of said guide arms by handle supports attached to the base open end and extending away from the base at an incline.

2. A band tool for removing individual items contained in a blister package having an upper surface with raised protrusions having a given width containing said items and a lower sheet holding said items within said protrusions, said tool comprising:

a) a base having a first end, a base open end opposite said first end, and parallel guide arms spaced at a distance to define a protrusion receiving space between said arms, said arms having distal and proximal ends;

b) a cutting blade on the inside of said first end toward said protrusion receiving space and said base open end, said blade consisting essentially of a piercing tip and slicing arms, said piercing tip extending toward said open end and said slicing arms extending outwardly from opposite sides of said tip, said slicing arms having distal ends integral with the distal ends of said guide arms; and c) a handle attached to said guide arms.

3. The tool of claim 2, wherein said handle includes handle supports attaching the handle to the parallel guide arms.

4. The tool of claim 3, wherein the handle supports taper away from the first end of the base.

5. The tool of claim 3, wherein the handle supports are attached to the base open end and extend away from the base at an incline.

6. The tool of claim 2, wherein the length of each of said slicing arms is greater than one-half of said distance.

7. The tool of claim 2, wherein said slicing arms have upper beveled surfaces.

8. The tool of claim 2, wherein said slicing arms curve from said piercing tip toward said guide arms.

9. The tool of claim 2, wherein said handle extends above said cutting blade.

10. The tool of claim 9, wherein the length of each of said slicing arms is greater than one-half of said distance.

11. The tool of claim 9, wherein said slicing arms have upper beveled surfaces.

12. The tool of claim 9, wherein said slicing arms curve from said piercing tip toward said guide arms.

13. A hand tool for removing individual items contained in a blister package having an upper surface with raised protrusions having a given width containing said items and a lower sheet holding said items within said protrusions, said tool comprising:

a) parallel guide arms spaced at a distance to define a protrusion receiving space between said arms, said arms having distal and proximal ends;

b) a cutting blade consisting essentially of a piercing tip and slicing arms, said piercing tip extending toward said protrusion receiving space and said slicing arms extending outwardly from opposite sides of said tip, said slicing arms having distal ends integral with the distal ends of said guide arms; and c) a handle attached to the proximal ends of said guide arms.

14. The tool of claim 13, wherein the length of each of said slicing arms is greater than one-half of said distance.

15. The tool of claim 13, wherein said slicing arms have upper beveled surfaces.

16. The tool of claim 13, wherein said slicing arms curve from said piercing tip toward said guide arms.

17. new The tool of claim 13, wherein said handle extends above said cutting blade.

* * * * *